United States Patent [19]

Pierre et al.

[11] 4,225,749

[45] Sep. 30, 1980

[54] SEALED POWER CABLE

[75] Inventors: Bernard Pierre; Ivan Eyraud, both of Lyons; Jean Gaubert, Miribel, all of France

[73] Assignee: Les Cables de Lyon, Lyons, France

[21] Appl. No.: 946,924

[22] Filed: Sep. 28, 1978

[30] Foreign Application Priority Data

Oct. 27, 1977 [FR] France ..... 77 32437

[51] Int. Cl.[3] ..... H01B 7/28

[52] U.S. Cl. ..... 174/107; 174/102 D; 174/102 SC; 174/105 SC; 174/106 D; 174/110 P; 174/116

[58] Field of Search ..... 174/102 D, 106 D, 102 SC, 174/105 SC, 106 SC, 107, 13, 23 R, 23 C, 110 P, 116

[56] References Cited

U.S. PATENT DOCUMENTS

| | | | |
|---|---|---|---|
| 2,890,263 | 6/1959 | Brandes | 174/102 D X |
| 3,943,271 | 3/1976 | Bahder | 174/102 D |

FOREIGN PATENT DOCUMENTS

| | | | |
|---|---|---|---|
| 245033 | 5/1960 | Australia | 174/107 |
| 1016340 | 9/1957 | Fed. Rep. of Germany | 174/102 |
| 764175 | 5/1934 | France | 174/102 |
| 43-1345 | 1/1968 | Japan | 174/13 |
| 44-19304 | 5/1969 | Japan | 174/102 D |
| 397539 | 8/1933 | United Kingdom | 174/13 |

*Primary Examiner*—Richard R. Kucia

*Attorney, Agent, or Firm*—Sughrue, Rothwell, Mion, Zinn and Macpeak

[57] ABSTRACT

Sealed power cables (e.g. for underground or submarine use) are often equipped with a metal sheath. A problem with some such cables is that their insulation is subject to greater thermal expansion of the cable during use than the metal sheath is capable of following. According to the present invention the metal sheath (5) is longitudinally corrugated either when the metal sheath is manufactured or by pressing a metal sheet which is originally plane over resilient ribs disposed longitudinally on the cable.

2 Claims, 4 Drawing Figures

SEALED POWER CABLE

FIELD OF THE INVENTION

The present invention relates to a sealed power cable and to a machine for manufacturing it.

BACKGROUND OF THE INVENTION

It is known that plastics materials are used more and more as insulators in manufacturing medium and high-tension electric cables. One of the commonest plastics materials used is reticulated or non-reticulated polyethylene. In the case of underground cables and especially in the case of submarine cables, the dielectric properties of polyethylene are in danger of being deteriorated by the ingress of dampness which promotes in particular the formation of arborescences and can lead to breakdown.

It is therefore necessary to provide a sealing sheath. The cables may be sealed by means of an extruded metal sheath, e.g. made of lead as has been done since the earliest electric cables, or made of aluminium, or even by means of a metal (copper, aluminium or steel) tape laid lengthwise and folded over the cable. The edges of the tape may be welded, or clipped, or merely made to overlap with or without adhesive fixing. Such a tape is generally covered, at least on one surface, with a plastics material which adheres to the insulator or to the outer protective sheath or to both simultaneously, and may adhere to both edges if they overlap. The sheath produced by means of a metal tape leads to a lighter and more economical cable structure. When it is required to impart a degree of flexibility to the cable, a transversally corrugated tape is used.

Unfortunately, the various types of sheath listed hereinabove have no radial elasticity. Now, polyethylene has a high coefficient of expansion and if full advantage is to be taken of the excellent heat resistance of polyethylene and especially of reticulated polyethylene, the sealing sheath must be able to withstand great expansion between minimum ambient temperature and maximum operation temperature without detriment to transversal and longitudinal sealing and without any unsticking which would promote ionization. In other words, the sealing sheath must follow the radial deformation of the insulator.

Preferred embodiments of the present invention provide a solution to this problem and allow the metal sheath to follow the radial deformation of the polyethylene insulator when the cable is used as a high-power conductor subject to thermal losses.

The present invention provides a sealed power cable which comprises, from its centre to its periphery, a stranded conductor which is covered with a first or inner screen of semiconductor material which is coated with an insulator which is surrounded by a second or outer screen of semiconductor material which is enveloped in a metal strip and with an outer sheath of plastics material, wherein the said metal strip has longitudinal corrugations in order to allow thermal expansion without affecting the sealing of said metal strip and that sealing means are disposed between the "troughs" of the corrugations of the metal strip and the second or outer semiconductor screen.

Embodiments of the invention are described with reference to the accopanying drawings.

DESCRIPTION OF PREFERRED EMBODIMENTS

Figure 1:
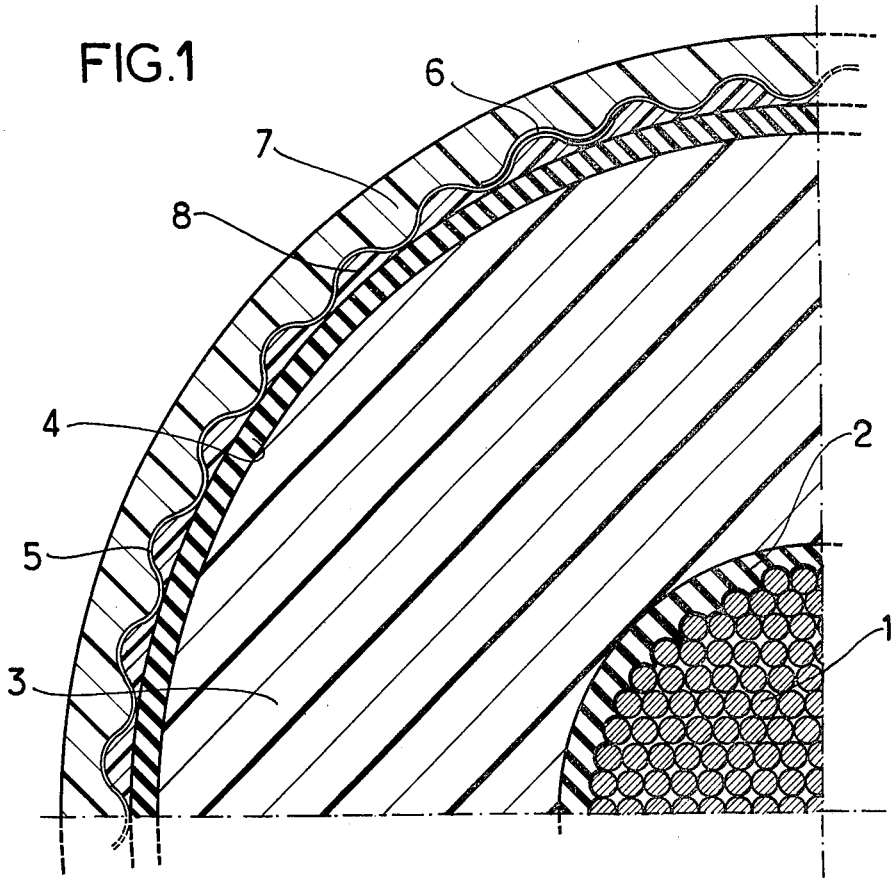
FIG. 1 is a partial cross-section view of a cable in accordance with the invention.

In FIG. 1, 1 designates a stranded conductor, 2 designates an extruded semiconductor inner screen, 3 designates insulation, and 4 designates an extruded semiconductor outer screen. These three layers can be deposited conventionally, either separately or simultaneously (by a three-headed extrusion machine). 5 designates a metal tape which acts as a metal screen and as a sealed sheath. The tape is corrugated longitudinally and folded over the cable. Its width is such that its edges overlap sufficiently at 6, e.g. by 10%; its thickness is determined as a function of electrical considerations, in particular the flow of short-circuit currents. Originally, at least its outer surface is covered with a layer of plastics material to provide good adherence on an outer protective sheath 7 made of a plastic material and possibly of a sealing compound 8 also made of plastics material which fills the gaps left by the corrugations of the metal tape and which can be insulator or a semiconductor. Good contact is provided between the metal tape 5 and the semiconductor outer screen 4 at the inner peaks of the corrugations in all circumstances by virtue of the binding provided by the protective sheath 7.

Figure 2:
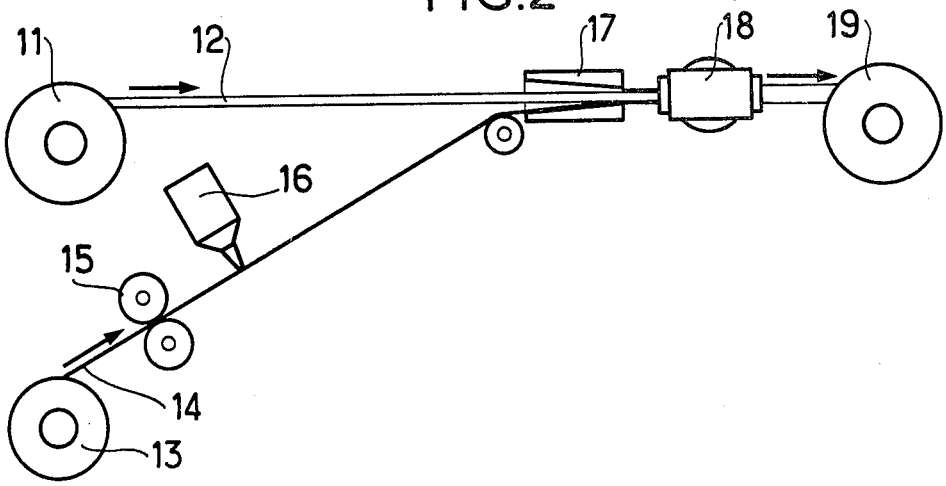
FIG. 2 is a diagramatic view of a machine for manufacturing the cable of FIG. 1.

In FIG. 2, 11 designates reel for paying out the cable 12, constituted by a conductor 1 covered with its insulator 3 and with its two extruded screens 2 and 4; 13 designates a reel for paying out a metal strip 14 which it is assumed is coated with plastics material on at least one of its surfaces. The metal strip is corrugated longitudinally by passing it through a device 15 which comprises, for example, two suitably profiled rollers. The sealing compound 8 is deposited on what will be the inner surface of the sealing sheath by a device 16 constituted for example by a cylindrical reservoir with a piston which extrudes the sealing compound through a flattened die; the flow is adjusted so that the corrugations will be completely filled with a small excess of material across the whole width of the metal strip 5 except in the overlapping zone 6. The strip metal is then folded round the cable by means of a shaping device 17 which conventionally comprises one or several progressive forming cones. Lastly, a sheathing device 18 deposits the plastics protective sheath 7 on the metal sealing sheath 6 and the finished cable is wound onto a reel 19. The protective sheath 7 is extruded by means of a pressure arrangement by which the outer corrugations of the sealing sheath 5 are perfectly filled and sufficient binding is provided to press the inner peaks of the corrugation onto the semiconductor screen 4.

The cable thus produced is a little less flexible than a cable produced by a transversely corrugated metal tape; however, it satisfies the bending tests imposed by prevailing standards and the sealing tests imposed which are carried out after the bending tests.

Figure 3:
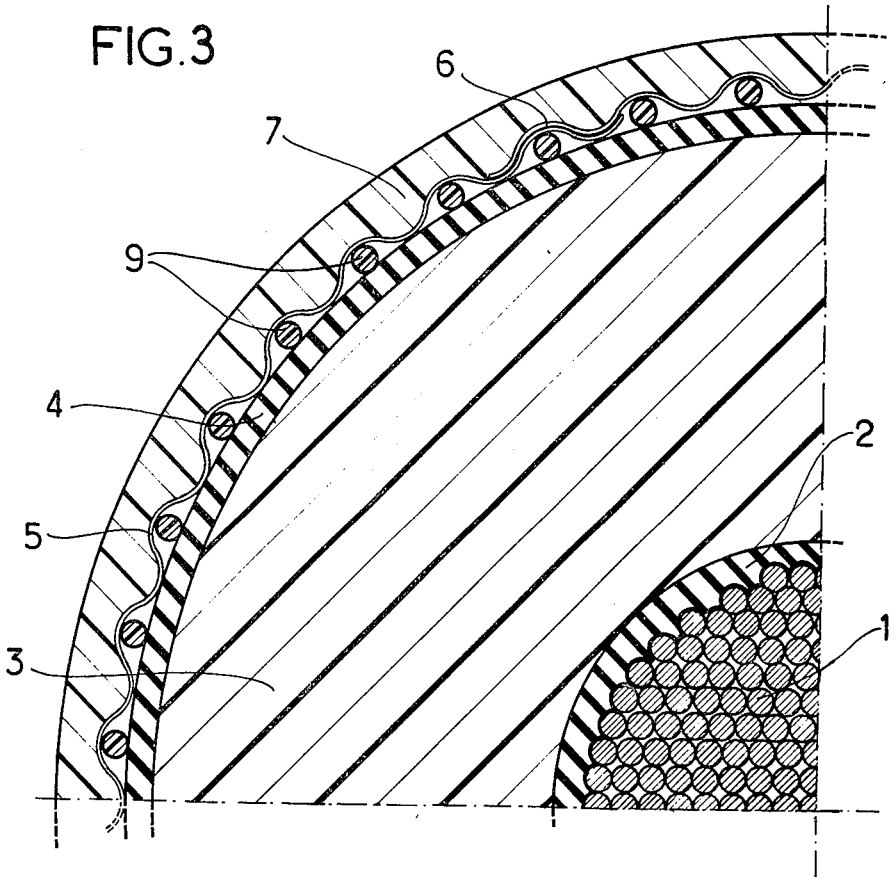
FIG. 3 is a variant of the present invention in the form of a partial cross-section view of a cable in which the metal tape is corrugated and longitudinally sealed in a different way from that of FIG. 1.

The cable of which a cross-section view is shown in FIG. 3 corresponds to a slightly different embodiment. The sealing compound is replaced by a worming (9) constituted by a plastics rod in which cellulose fibres are fixed, for example in accordance with the method described in U.S. Pat. No. 3,999,003, these fibers containing carbon powder so as to impart some degree of electrical conductivity to the worming.

Figure 4:
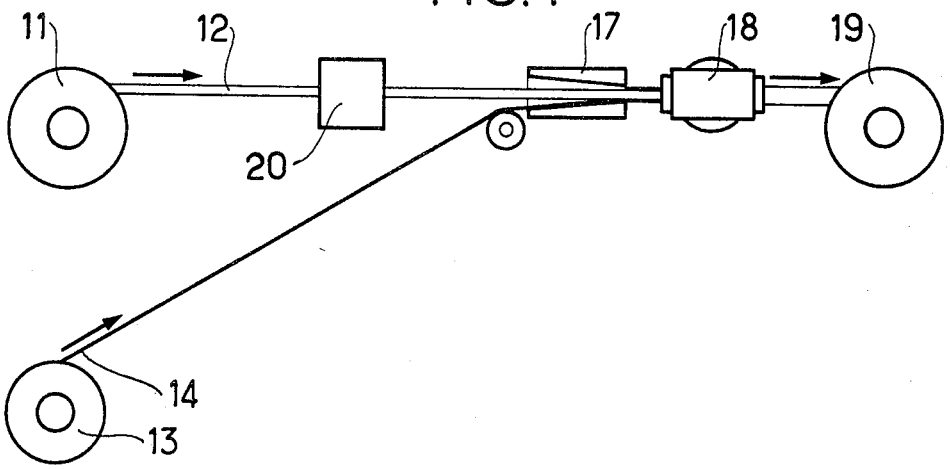
FIG. 4 is a diagramatic view of a machine for manufacturing a cable in accordance with the variant in FIG. 3.

The machine illustrated in FIG. 4 uses as many strands of worming 9 as there are corrugations to be formed in the sealing sheath, said strands being placed on the cable longitudinally or in a long pitch by means of a conventional device 20 immediately before the metal strip forming device. The forming device is the same as previously, but is neither corrugated nor compounded (the devices 15 and 16 not having been included). The binding provided by the protective sheath corrugates the metal strip by thrusting it between the strands of worming. In the case of accidental perforation of the metal strip, longitudinal sealing is provided by the swelling of the cellulose fibres under the effect of dampness.

We claim:

1. A sealed power cable comprising, from its center to its periphery, a stranded conductor, a first inner screen of semi-conductor material, an insulator, a second outer screen of semi-conductor material, a metal strip and an outer sheath of plastic material, said metal strip being coated with a layer of plastic material at least on one of its surface to provide good adherence with the adjacent component, the improvement comprising: sealing means formed by plastic rods in which cellulose fibers are fixed, said rods being placed generally longitudinally on said cable and generally parallel to the generatrices of the cable, and wherein said metal strip overlies said rods and is generally longitudinally corrugated by contact with said rods to allow thermal expansion without affecting the sealing of the metal strip and the sealing means defined by said plastic rods disposed between the "troughs" or the corrugations of the metal strips and the second outer semiconductor screen.

2. The power cable according to claim 1, wherein said rods are placed generally longitudinally on the cable with a long helical pitch about the axis of the cable.

* * * * *